US007731493B2

(12) United States Patent
Starnini et al.

(10) Patent No.: US 7,731,493 B2
(45) **Date of Patent: *Jun. 8, 2010**

(54) GAS BURNER

(75) Inventors: Marco Starnini, Forli (IT); Stefano Strada, Forli (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 0 days.

This patent is subject to a terminal disclaimer.

(21) Appl. No.: 11/816,239

(22) PCT Filed: Jan. 17, 2006

(86) PCT No.: PCT/EP2006/050493

§ 371 (c)(1),
(2), (4) Date: Feb. 18, 2008

(87) PCT Pub. No.: WO2006/087260

PCT Pub. Date: Aug. 24, 2006

(65) Prior Publication Data

US 2008/0145809 A1 Jun. 19, 2008

(30) Foreign Application Priority Data

Feb. 17, 2005 (EP) ..... 05101195

(51) Int. Cl.
*F23D 14/06* (2006.01)
*F23D 14/62* (2006.01)

(52) U.S. Cl. ..... 431/354; 431/266; 431/349; 126/39 B; 126/39 E

(58) Field of Classification Search ..... 431/354, 431/349; 126/39 E, 39 B
See application file for complete search history.

(56) References Cited

U.S. PATENT DOCUMENTS

| | | | | |
|---|---|---|---|---|
| 5,328,357 | A * | 7/1994 | Riehl | 431/266 |
| 5,464,345 | A | 11/1995 | Kwiatek et al. | |
| 6,889,685 | B2 * | 5/2005 | Dane | 126/39 B |
| 7,040,890 | B2 * | 5/2006 | Todoli et al. | 431/266 |
| 2003/0075164 | A1 * | 4/2003 | Dane | 126/39 R |
| 2006/0121402 | A1 * | 6/2006 | Bettinzoli | 431/354 |

FOREIGN PATENT DOCUMENTS

| | | | |
|---|---|---|---|
| DE | EP1067334 | A1 * | 10/2001 |
| EP | 1067334 | | 1/2001 |
| EP | 1067334 | A1 * | 1/2001 |
| EP | 1512909 | | 3/2005 |
| WO | 03098107 | | 11/2003 |
| WO | 2004044490 | | 5/2004 |
| WO | WO 2004044490 | A1 * | 5/2004 |
| WO | WO2004044490 | A1 * | 5/2004 |

* cited by examiner

*Primary Examiner*—Steven B McAllister
*Assistant Examiner*—Nikhil Mashruwala
(74) *Attorney, Agent, or Firm*—Pearne & Gordon LLP

(57) ABSTRACT

Gas burner, in particular for domestic cooking appliances, comprising a bowl-shaped body (10) associated with a gas injector, a toothed crown (12) with a plurality of first flame ports (13) circumferentially arranged along the periphery of the crown (12) and an upper cap (14) to close the burner top. A peripheral step (15) is formed on at least a part of the external surface of the toothed crown (12) and second flame ports (17) of reduced area are circumferentially provided along the periphery of the crown (12) in such a way that adjacent first flame ports (13) are spaced apart from each other by means of a single second flame port (17) disposed therebetween.

6 Claims, 4 Drawing Sheets

GAS BURNER

The present invention relates to a new kind of gas burners, in particular for use in a domestic cooking appliances, which is provided with improved burner crowns.

A gas burner is substantially formed by a bowl-shaped body, a toothed crown and an upper cap.

In this kind of burners, primary air is aspirated, over the appliance work plate, through the body-crown gap. The bowl-shaped body is associated with an injector through which the gas is supplied, while primary air is, mainly, sucked inside the burner crown by means of the friction with gas jet. The burner crown is provided on its circumference with a plurality of radiant openings, called flame ports to let the ignited gas-air mixture to go out in a radial direction. The cap closes the burner top and together with the burner crown defines the flame ports dimensions.

A spark plug, connected to a spark generator, could be fitted within the burner, for this reason the burner is designed with proper plug setting, provided on the burner body and on the burner crown.

This kind of gas burner has flame ports equidistant each others of two or more different sizes. Moreover, the flame ports could be different also in length and width, in order to let the gas-air mixture to leave the burner at the desired velocity, pressure, inclination and at the requested distribution along the burner circumference.

The main performances for such a kind of burner are flame stability and combustion quality: both are functions of the quantity of primary aeration ratio in the mixture. By increasing the primary aeration ratio, the combustion improves but due to the increase of the gas-air mixture volume the flame stability decreases, approaching the flame lift limit.

The flame stability under different operative conditions is a serious problem for all kind of gas burners.

A main drawback is the flame breakdown from the burner cap, which occurs both in longitudinal and in circular direction during the normal functioning of the burner.

The stability of the flame is function of:

(i) burning velocity of the air-gas mixture;

(ii) the mass ratio between gas and air in the mixture (iii) the total area of the burner ports.

To stabilise a flame in a such kind of burners the most used techniques are: a pilot flame and a cap projection.

Some burner ports, usually the small ones, have the function of a pilot flame, and they guarantee the flame stability when flow variations, and external air turbulence could disturb the flame. Another factor that permits to obtain flame stability is the projection of the cap, this is usually bigger in diameter compared to the burner crown, and this helps to anchor the flame.

Further it is well known in the art that to achieve a good combustion, it is important to avoid the contact between the flame and the pan supporting grids. Possible contacts inevitably cool down the flame with the result that the CO production increases and the whole combustion performance deteriorates. Since an increase of mixture volume entails an increase of the flame volume, it is clear that also the contact between the flame and the pan supporting grids enhances worsening the combustion. Commonly to avoid the above mentioned drawback the main flame is reduced in proximity to the grid arms. Such reduction is obtained by providing flame ports of reduced area on the crown of the gas burner in correspondence to the positions where the grid arms are to be arranged close to the burner. Normally these flame ports are provided at angular positions spaced apart from each other of 90° along the circumference of the crown. But different positions can be envisaged depending on the shape of the pan supporting grid.

The flame ports of reduced area cause a non-homogeneous flame distribution and flame interruptions around the burner crown.

Further an another disadvantage relating to such ports is that the burner bodies are to be assembled depending on the type of grid, which are to be arranged on the cook top. That is to say for a particular shaped grid the toothed crown and the bowl body are to be assembled in such a way that the flame ports of reduced area face the grid arms, when burners and grids are installed on the cook top.

It therefore causes a proliferation of variability in the factories assembly lines and thus an increase of cost and complexity results as a consequence.

The main scope of the present invention is to provide a "mini vertical venturi tube" gas burner (primary aeration occurs over the appliance work plate) with a modified crown, which allows to overcome the above drawbacks, so as its functional and aesthetic characteristics are improved, without the need to use a special and costly technology.

This and other scopes are obtained with a burner as claimed in the claims of the present patent.

The invention will be better appreciated from the following description given solely by way of non-limiting example and with reference to the accompanying drawings, wherein.

Figure 1:
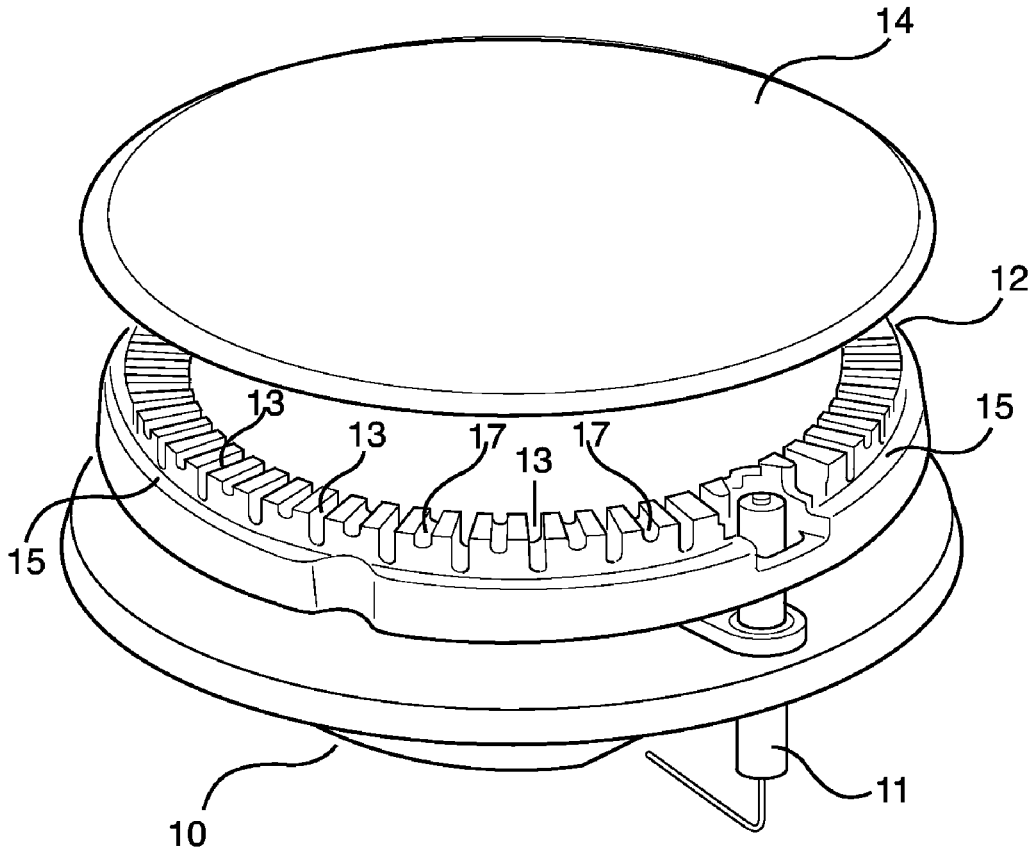
FIG. 1 is an exploded view of a gas burner according to the present invention.

With reference to FIG. 1, a gas burner comprises: a bowl-shaped body 10, which is associated with a gas injector (not shown) and with a spark plug 11; a toothed crown 12, which leans on said bowl-shaped body 10 and is provided with a plurality of first flame ports 13 circumferentially arranged along the periphery of the crown 12; and an upper cap 14, which closes the burner top.

Figure 2:
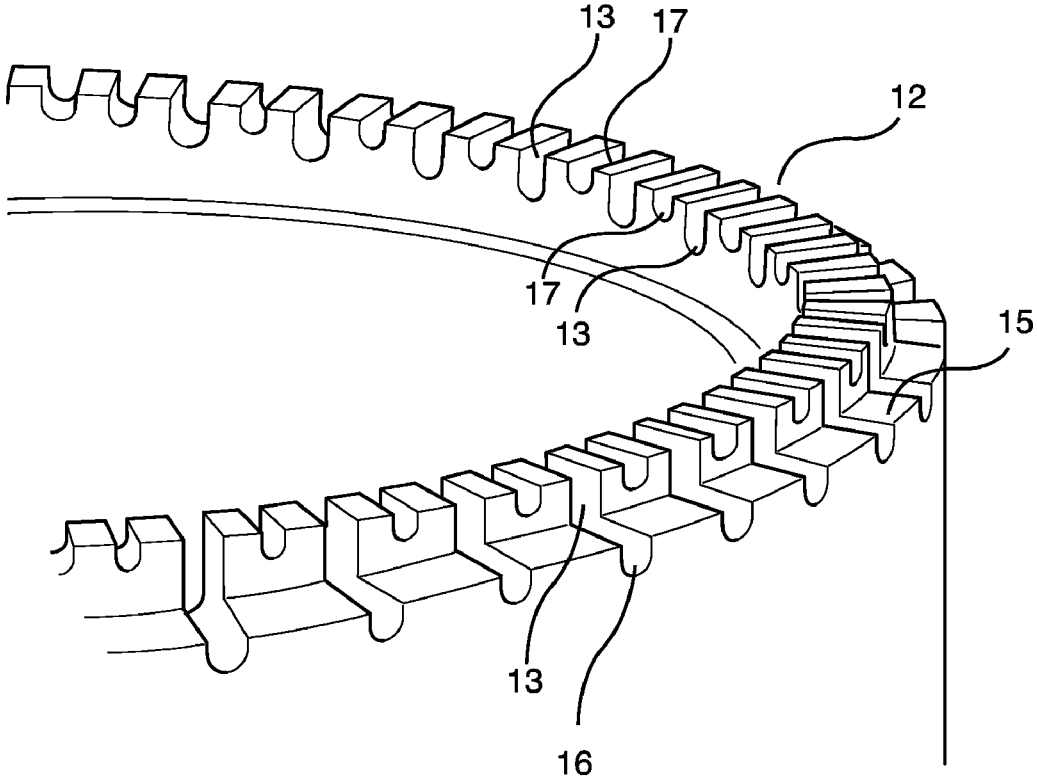
FIG. 2 is an enlarged perspective view of a part of a gas burner according to the present invention.
Figure 3:
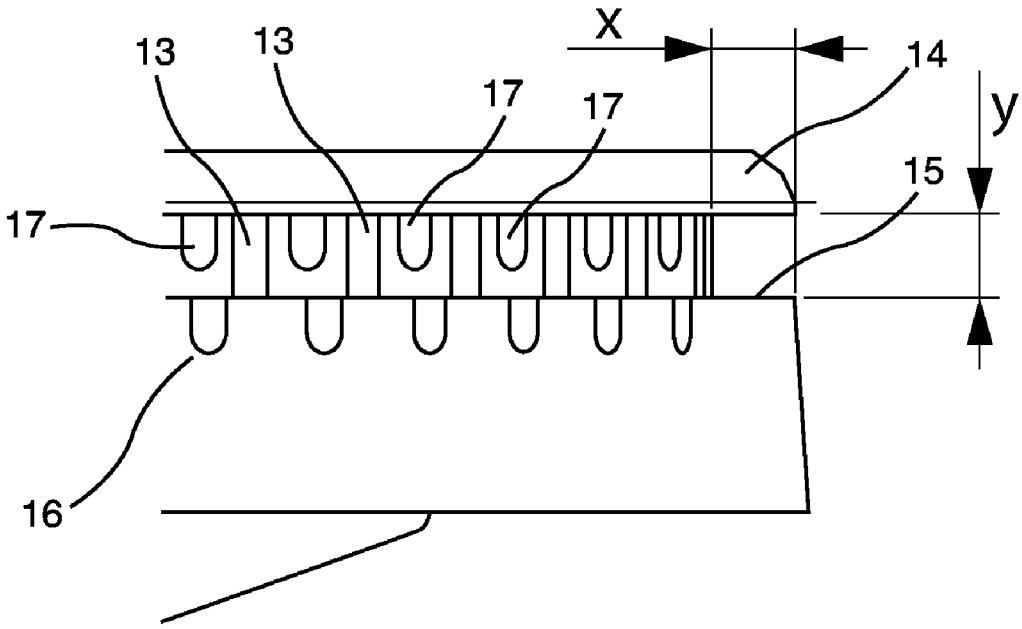
FIG. 3 is an elevation side view of the gas burner of FIG. 2.
Figure 4:
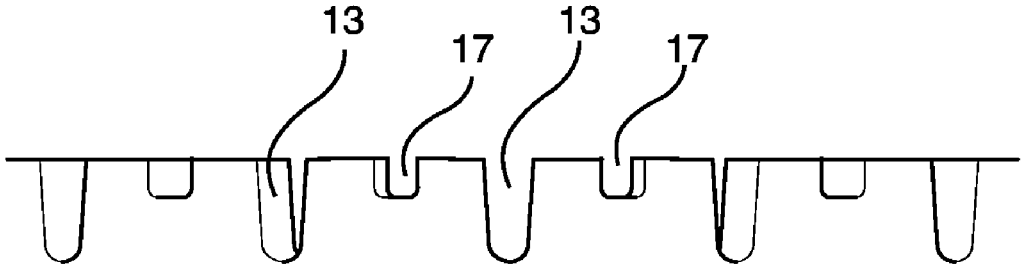
FIG. 4 is an enlarged side view of the flame ports distribution on the burner crown according to the present invention.

According to the present invention, a peripheral step 15 is formed on at least a part of the external surface of the toothed crown 12. The peripheral step 15 is preferably provided at a level lower than that of the first flame ports 13 and its upper surface is smooth (FIG. 1). Alternatively, at least part of the peripheral step 15 is crossed by a number of radial grooves 16, which are connected with corresponding first flame ports 13 of the toothed crown 12 (FIGS. 2 and 3).

Shape and size of the peripheral step 15, in particular the ratio between width "x" and height "y" (FIG. 3), may be chosen depending on the kind of gas to be used and on different functional parameters of the burner itself.

The peripheral step 15 gives to the burner ports an innovative double section shape, with the inner one (firstly met by the gas) having a reduced section compared with the outer one. This feature creates a kind of "double conduit" which ensures a reduction for the flame velocity on the external periphery of the toothed crown 12, so improving the flame stability and avoiding the danger of a flame detachment.

Further according to the present invention second flame ports 17 of reduced area are circumferentially arranged along the periphery of the crown in such a way that second flame ports 17 and first flame ports 13 are alternately disposed one following the other.

In practise adjacent first flame ports 13 are spaced apart from each other by means of a single second flame port 17 therebetween, the first flame ports 13 and the seconds flame ports 17 being provided on the crown equidistantly.

The peripheral step 15 and the above mentioned alternate pattern of the flame ports 13,17 allow also to obtain a better distribution of the flame around the toothed crown 12 and a faster cross-lighting of the gas-air mixture leaving the burner. Said advantages are achieved thanks to the continuity of the flame anchorage to the crown, which is ensured by the flame speed reduction, created by step 15.

Further the alternate pattern of the flame ports 13,17 of the crown avoids the necessity to rotate the burner body on the assembly lines.

A unique factory assembly line is therefore needed for the burner bodies since a single type of crown is adapted for a plurality of differently shaped grids.

At last, by adopting the disclosed solution of the peripheral step 15, it is possible to employ an upper cap 14 having substantially the same diameter of the toothed crown 12, without any danger of flame detachment. This feature further improves the functionality and aesthetic of the burner. Indeed, besides all the mentioned advantages, the burner according to the invention has also a primary aeration ratio increased enough to obtain good combustion performances even when the flame is not interrupted under the pan support arms.

The invention claimed is:

1. Gas burner, in particular for domestic cooking appliances, comprising a bowl-shaped body associated with a gas injector, a single toothed crown with a plurality of first flame ports circumferentially arranged over substantially the whole of a periphery of the crown and an upper cap to close the burner top, a peripheral step is formed on at least a part of the external surface of the toothed crown and second flame ports of reduced area are circumferentially provided along the periphery of the crown, wherein said adjacent first flame ports are spaced apart from each other by means of a single second flame port disposed therebetween so that said second flame ports are positioned equidistantly between two adjacent first flame ports over substantially the whole of the periphery of the crown.

2. Gas burner according to claim 1, wherein said peripheral step is formed at a level lower than that of the first flame ports.

3. Gas burner according to claim 1, wherein said peripheral step has a smooth surface.

4. Gas burner according to claim 1 wherein said peripheral step is at least partially crossed by radial grooves connected with corresponding first flame ports of the toothed crown.

5. Gas burner according to claim 1, wherein the upper cap has substantially the same diameter of the toothed crown.

6. Gas burner according to claim 1, further comprising a mini vertical Venturi tube for occurring primary aeration over the appliance work plate.

* * * * *